US007903124B2

(12) United States Patent
Herrick et al.

(10) Patent No.: US 7,903,124 B2
(45) Date of Patent: Mar. 8, 2011

(54) INDIVIDUAL CHANNEL FILTERING OF PALETTIZED IMAGE FORMATS

(75) Inventors: Jason W. Herrick, Newark, CA (US); Darren D. Neuman, Palo Alto, CA (US); Glenn Nissen, Caledon East (CA)

(73) Assignee: Broadcom Corporation, Irvine, CA (US)

( * ) Notice: Subject to any disclaimer, the term of this patent is extended or adjusted under 35 U.S.C. 154(b) by 858 days.

(21) Appl. No.: 11/334,750

(22) Filed: Jan. 19, 2006

(65) Prior Publication Data

US 2006/0158457 A1 Jul. 20, 2006

Related U.S. Application Data

(60) Provisional application No. 60/644,528, filed on Jan. 19, 2005.

(51) Int. Cl.
*G09G 5/02* (2006.01)

(52) U.S. Cl. ..... 345/601; 345/589; 345/602

(58) Field of Classification Search ..... None
See application file for complete search history.

(56) References Cited

U.S. PATENT DOCUMENTS

| | | | | |
|---|---|---|---|---|
| 5,883,633 | A * | 3/1999 | Gill et al. | 345/589 |
| 6,037,982 | A * | 3/2000 | Coelho | 348/393.1 |
| 2003/0011610 | A1* | 1/2003 | Kitsutaka | 345/582 |
| 2005/0168620 | A1* | 8/2005 | Shiraishi | 348/345 |

* cited by examiner

*Primary Examiner* — Xiao M Wu
*Assistant Examiner* — Jwalant Amin
(74) *Attorney, Agent, or Firm* — Sterne Kessler Goldstein & Fox P.L.L.C.

(57) ABSTRACT

A method, system, and a computer program product for filtering palettized image formats are presented. In an embodiment, data is retrieved from a palette of an image. Data associated with a channel of the palette is filtered, and stored, for example, together with a pixel buffer of the image to form a filtered image. Additionally, a method, system, and a computer program product for displaying images stored in a modified palettized image format are presented. In an embodiment, data is retrieved from a palette and from a pixel buffer of an image stored in modified palettized image format. Filtered pixels of the image are formed by combining, for each pixel in the pixel buffer, data retrieved from the palette with filtered data, retrieved from the pixel buffer. The modified palettized image is rendered on a display by displaying the filtered pixels.

21 Claims, 12 Drawing Sheets

INDIVIDUAL CHANNEL FILTERING OF PALETTIZED IMAGE FORMATS

CROSS-REFERENCE TO RELATED APPLICATIONS

The present application claims the benefit of U.S. Provisional Patent Application No. 60/644,528, filed Jan. 19, 2005, which is incorporated herein by reference.

FIELD OF THE INVENTION

The present invention relates generally to the filtering of digital images. More particularly, it relates to individual channel filtering of palettized image formats.

BACKGROUND OF THE INVENTION

A palettized image format is one in which color information is not directly stored by the pixels of an image data file. Instead, the pixels of the image data file correspond to an index in a color palette. This index, in turn, corresponds to a vector of channel values, wherein the vector defines a color in the color palette. Because more data bits typically are required to represent a vector of channel values than to represent a color palette index, a palette-based format typically reduces the memory space required for storing an image.

FIG. 1 illustrates how a pixel 100 of a pixel image 110, in palettized image format, is rendered on a display 120. As shown in FIG. 1, pixel image 110 includes a color palette 101 and a pixel buffer 102. Color palette 101 includes an index list 106 and an array of color channels 108. The value of pixel 100 in pixel buffer 102 corresponds to an index 104 of index list 106. Index 104, in turn, corresponds to a vector of color values 105. It is the vector of color values 105, rather than the value of pixel 100 in pixel buffer 102, that is used by display 120 to generate pixel 100.

One drawback of storing images in a palettized format is that it often results in a loss of color information. This loss of color information is due to the fact that only a limited number of colors are available in a typical color palette.

One known filtering technique for filtering palettized images, such as pixel image 110, is full-channel filtering. This technique involves filtering all of the color channels of the color palette and saving the output of the filtering process.

FIG. 2 is a schematic diagram that illustrates the full-channel filtering technique. As shown in FIG. 2, each pixel 100 of pixel buffer 102 is converted into a vector of color values, and filtered by filter 200 to form a second pixel buffer 210. Pixel buffer 210 can be displayed using display 120 (see FIG. 1). Pixel buffer 210 that results from full-channel filtering is no longer in palettized format. As a result, the memory footprint of an image filtered in accordance with the full-channel filtering technique is larger than the original unfiltered image. For example, applying full-channel filtering to an 8 bit/pixel palettized image can result in a filtered image that has 24 bits/pixel, in the case of 3 channels in the color palette (i.e., a filtered image that is approximately 3 times larger than the unfiltered image).

Another known filtering technique for filtering palettized images is the reverse palette lookup technique, which is illustrated in FIG. 3. This technique attempts to improve on the full-channel filtering technique by re-transforming pixel buffer 210 generated for each pixel of pixel buffer 102 into an index value again using color palette 302. According to this technique, the index values corresponding to the generated vectors of color values, rather than the vectors of color values, are stored in an image file 300. The reversal algorithm necessary for this technique, however, requires that each vector of color value corresponding to a pixel of pixel buffer 210 must be compared to the vectors of color values of a color palette 302 to find the closest approximation of a filtered color in color palette 302. Color palette 302 may or may not be the same as color palette 101. Thus, the reverse palette lookup technique is both computationally intense and time consuming. It also can result in a loss of color information due to the limited number of colors available in color palette 302, which must be used to represent the filtered vectors of color values.

What is needed therefore are filtering techniques for filtering palettized images that overcome the disadvantages described above.

BRIEF SUMMARY OF THE INVENTION

The present invention is directed to an image filtering technique that minimizes the memory footprint of a filtered image, while maintaining the original image information. In an embodiment, the present invention comprises an individual channel filtering technique for palettized image formats.

According to one aspect of the invention, there is provided a method, system, and a computer program product for filtering digital images stored in palettized format. In one embodiment, data is retrieved from a digital image stored in palettized image format. The palette includes a plurality of channel values, each channel value associated with one of a plurality of channels of the palette. In an embodiment, data associated with a first channel of the palette is filtered and stored together with a pixel buffer of the digital image, thereby forming a filtered image. In another embodiment, data associated with one or more channels of the palette is filtered and stored together with the pixel buffer of the digital image.

According to another aspect of the invention, there is provided a method, system, and a computer program product for displaying digital images stored in a modified palettized image format. In one embodiment, data is retrieved from a palette and from a pixel buffer of a digital image stored in modified palettized image format. The pixel buffer includes a plurality of pixels. Each pixel includes an index to a palette as well as at least one filtered channel value. When de-referencing a pixel (e.g., display or other purpose), the pixel's palette index is de-referenced resulting in channel values from an entry in the palette. These channel values are combined with the pixel's filtered channel value(s) to generate a modified set of channel values.

The present invention provides a number of advantages over conventional filtering means. In addition to minimizing the size of a filtered palettized image in embodiments, the invention allows for selecting and filtering any combination of channels of a color palette, thereby avoiding the unnecessary filtering of channels when their filtering is not needed. Furthermore, the filtered image format according to the present invention comprises both the original source palette and the selected filtered channels. As a result, the original image can still be rendered from the filtered image file. Alternatively, an image is rendered by combining the filtered channels from the filtered image format and the non-filtered channels retrieved from the original source palette.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

The present invention will be described with reference to the accompanying drawings. The drawing in which an element first appears is typically indicated by the leftmost digit (s) in the corresponding reference number.

DETAILED DESCRIPTION OF THE INVENTION

Figure 1:
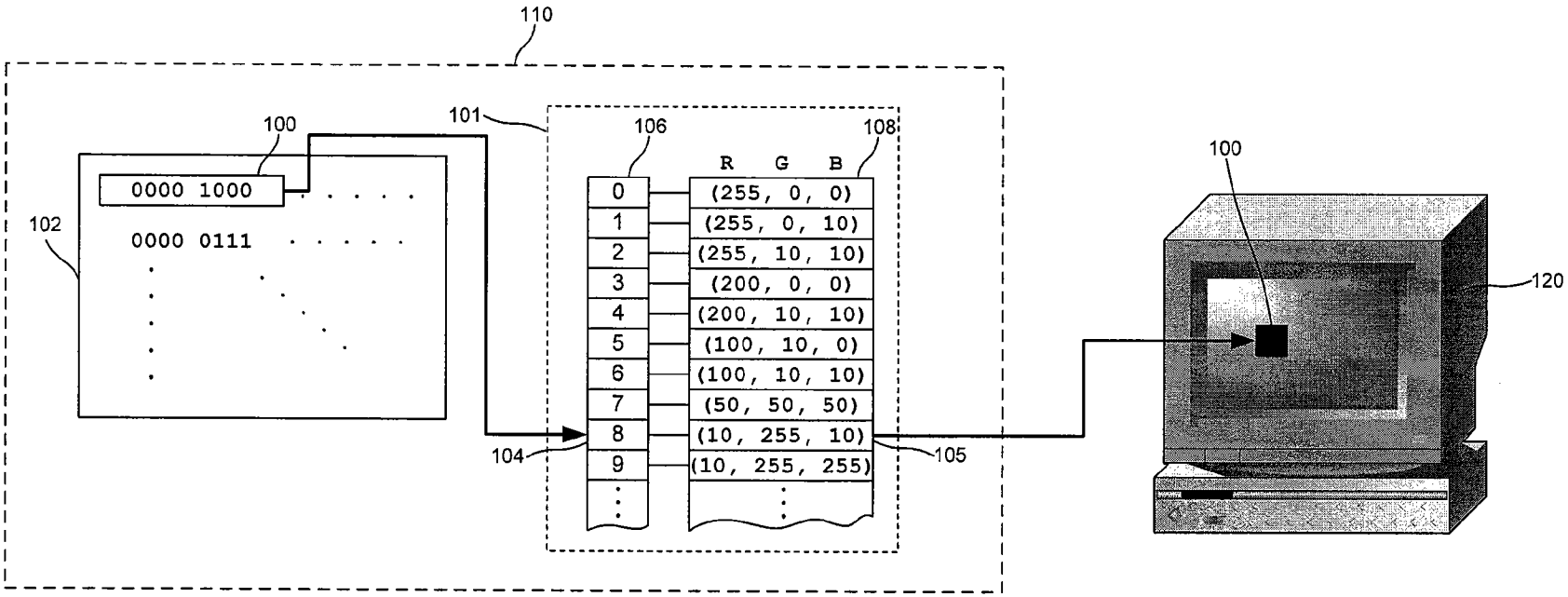
FIG. 1 is a schematic diagram illustrating the rendering process for pixels of an image stored in palettized image format.
Figure 2:
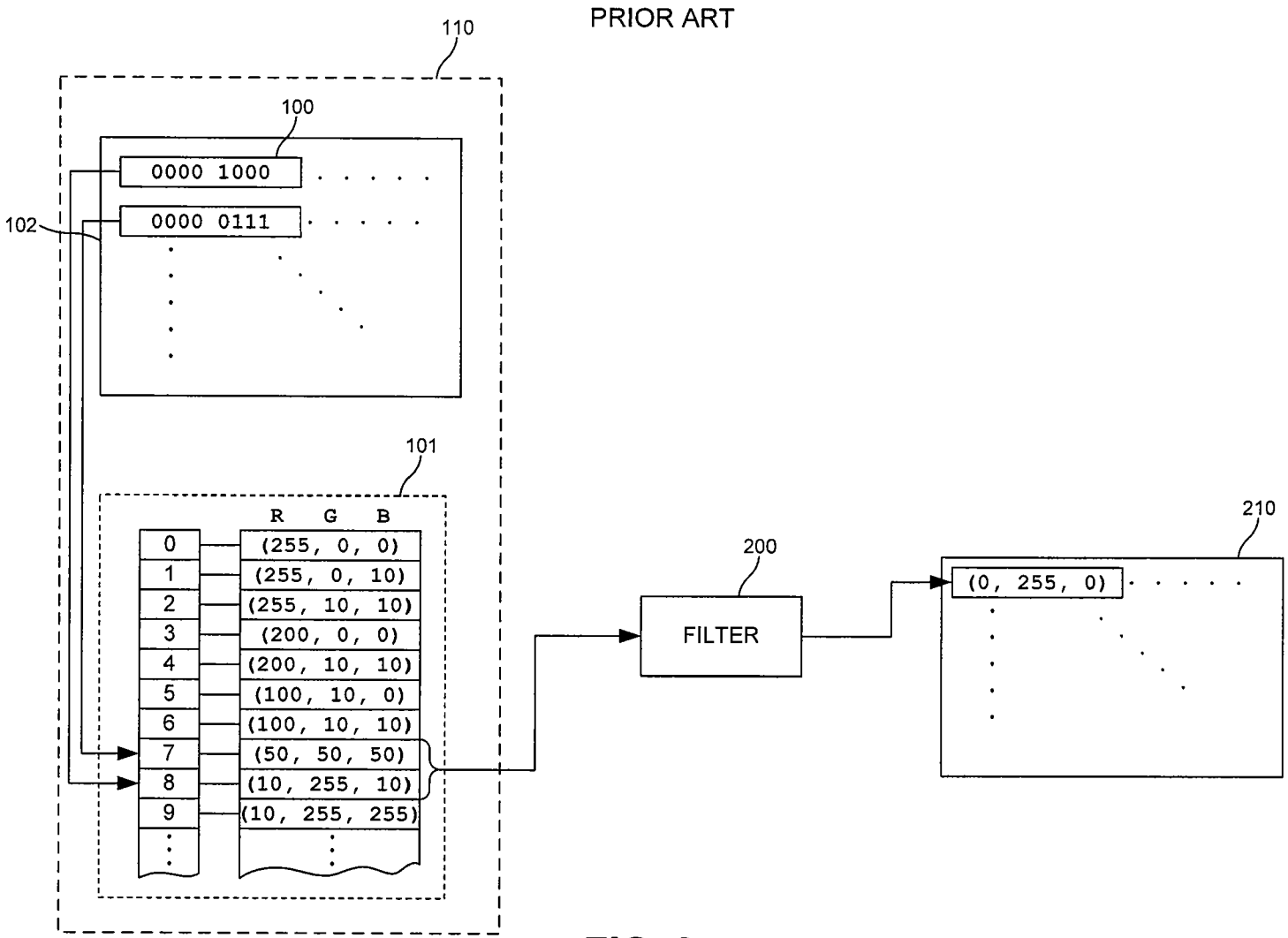
FIG. 2 is a schematic diagram illustrating the full-channel filtering technique for filtering images stored in palettized image format.
Figure 3:
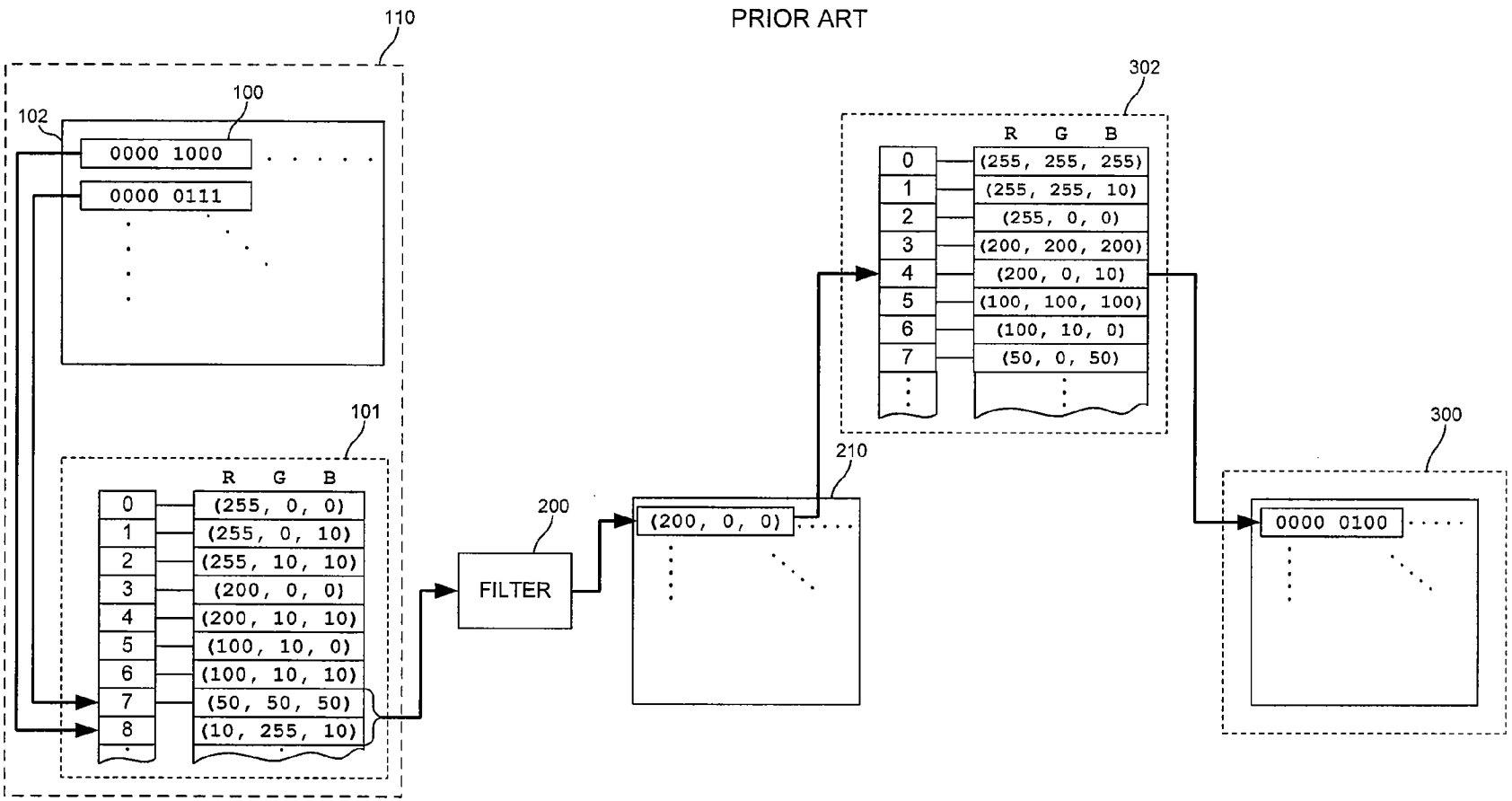
FIG. 3 is a schematic diagram illustrating the reverse palette lookup filtering technique for filtering images stored in palettized image format.
Figure 4:
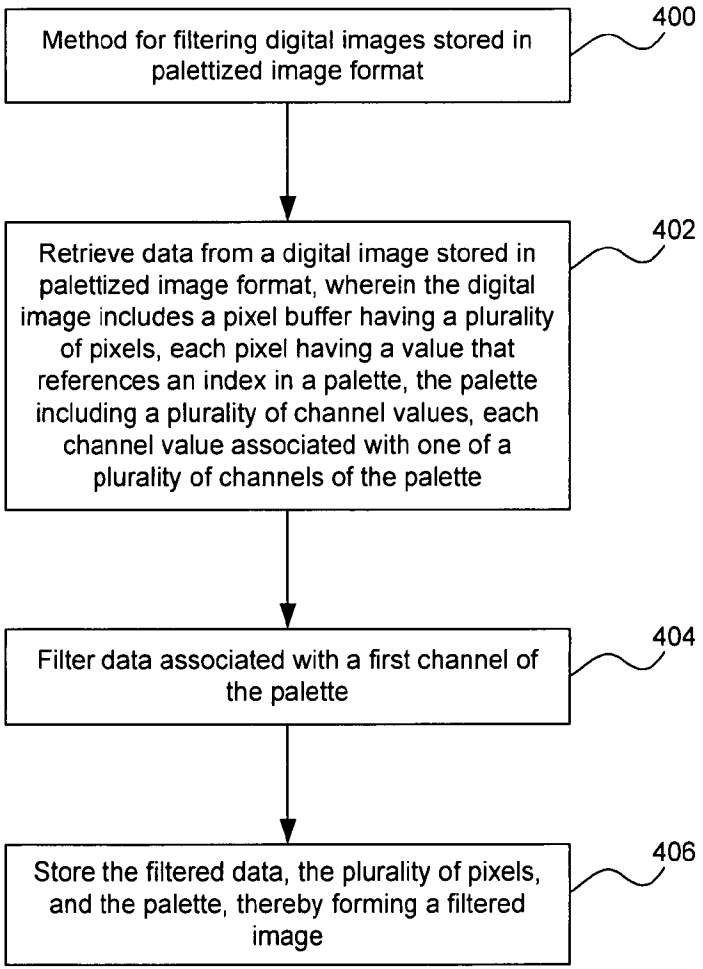
FIG. 4 is a flowchart illustrating a method for filtering images stored in palettized image format according to an embodiment of the present invention.

FIG. 4 is a flowchart of a method 400 for filtering images stored in palettized image format according to an embodiment of the present invention. Method 400 includes three steps 402, 404, and 406.

In step 402, data is retrieved from a digital image stored in palettized image format. The pixel buffer includes a plurality of pixels, wherein each pixel value references an entry in a palette. Each palette entry includes a plurality of channel values, wherein each channel value is associated with one of a plurality of channels of the palette.

In one embodiment, the palette includes red, green, and blue channels, and it includes red channel values, green channel values and blue channel values. The red channel values are associated with the red channel of the palette. The green channel values are associated with the green channel of the palette. The blue channel values are associated with the blue channel of the palette. In another embodiment, the palette includes luminance (Y) channel values, red chrominance (Cr) channel values, and blue chrominance (Cb) channel values associated with luminance, red chrominance, and blue chrominance channels. Other known schemes can also be used.

In step 404, data associated with a first channel of the palette is filtered. This filtering can involve any appropriate filtering technique, selected to achieve a particular result. This may include, for example, filtering data associated with one particular channel from adjacent pixels in the image. In some embodiments of the present invention, data associated with more than one channel of the palette is filtered to produce filtered data. In an embodiment, data associated with the luminance Y channel of a YCrCb image is filtered to perform anti-flutter filtering.

In step 406, in an embodiment, the filtered data is stored together with the plurality of pixel values in a pixel buffer with the original palette to form a filtered image. Each of the pixel values references an index in the palette.

Each of these steps of method 400 will now be described in greater detail with reference to FIGS. 5-9.

Figure 5:
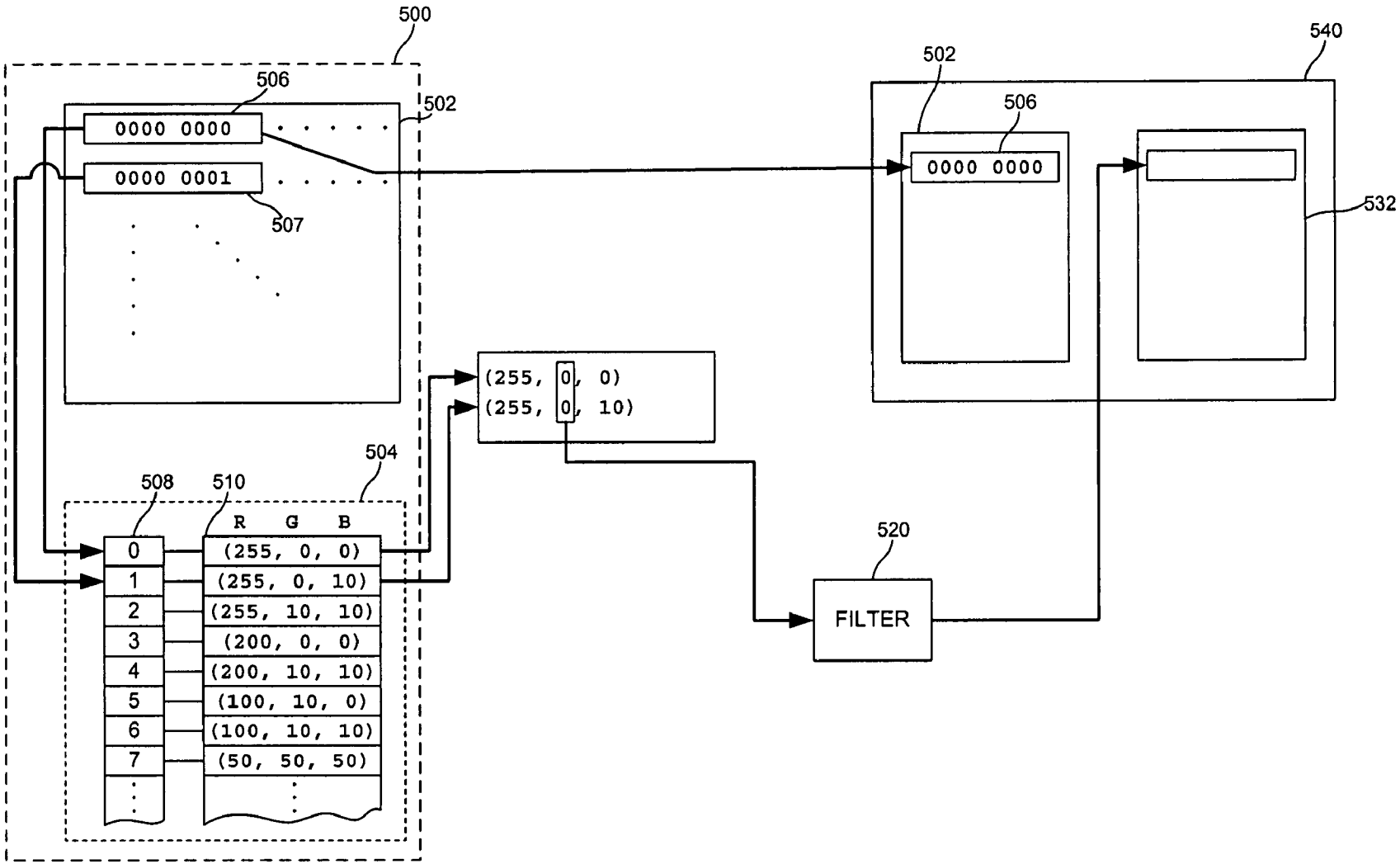
FIG. 5 is a schematic diagram illustrating image filtering according to the method of FIG. 4.

FIG. 5 illustrates the filtering of an image 500 in accordance with method 400. As shown in FIG. 5, image 500 includes a pixel buffer 502 and a palette 504. Pixel buffer 502 contains several pixels, such as, for example, pixels 506 and 507. Palette 504 includes an index list 508 and an array of channel vectors 510.

To filter image 500, in accordance with step 402 of method 400, data is retrieved from pixel buffer 502 and palette 504 of image 500. Pixel values (e.g., pixels 506 and 507) from pixel buffer 502 are de-referenced to corresponding indices in palette 504. For example, as shown in FIG. 5, pixel value 506 is de-referenced to index 0 of palette 504. In turn, palette indices are each associated with a plurality of channel values. In an embodiment, step 402 includes generating a buffer including vectors of channel values that each corresponds to a pixel of pixel buffer 502.

In an embodiment, one or more channels are selected for filtering. As shown in FIG. 5, in step 404 of method 400, a selected channel is filtered by a filter 520 to form filtered data. In the example of FIG. 5, the green (G) channel is individually filtered to form filtered channel 532. In an embodiment, filtering involves interpolating values of adjacent pixels in the image to create new values. The red and blue channels are not filtered in the example.

The filtered data of step 404 is stored together with pixel buffer 502, in accordance with step 406 of method 400, to form a filtered image 540. Image file 540 together with palette 504 can be used to display the filtered image. Although filtered channel 532 is shown in FIG. 5 as being separate from pixel buffer 502 in filtered image file 540, it need not exist as a separate data structure from pixel buffer 502 to implement the present invention. The filtered channel can be stored in a variety of ways including being separate, concatenated, or interleaved with the data of pixel buffer 502 to form filtered image file 540. Image file 540 is in a modified palettized image format.

As shown in FIG. 5, in one embodiment of the present invention, pixel 506 in pixel buffer 502 is as an 8 bit binary number that corresponds to a color in palette 504. Other representations and/or different numbers of bits can also be used. The values of the pixels 506 shown in FIG. 5 correspond to index values in index list 508. Other indexing schemes can be used.

In an embodiment, palette 504 includes up to 256 colors, wherein each color is represented by a vector of channel values in the array of channels. The invention is not limited, however, to this example embodiment. In FIG. 5, each vector of channel values is illustrated as including three channel values corresponding to an RGB (Red, Green, Blue) color representation. In embodiments of the present invention, a vector of channel values may include, for example, more than three channel values, and other color representations such as, for example, ARGB (Alpha RGB), YCrCb (Luminance, Red Chrominance, Blue Chrominance), AYCrCb (Alpha YCrCb) can be used. Furthermore, the channel values are shown as decimal numbers ranging in value from 0 to 255. The invention is not, however, limited to this example. Based on the description herein, persons skilled in the relevant art(s) will understand that other representations can also be used for the channel values. The number of bits and format used to represent entries in filtered image file 540 also can vary without deviating from the scope of the present invention.

Figure 6:
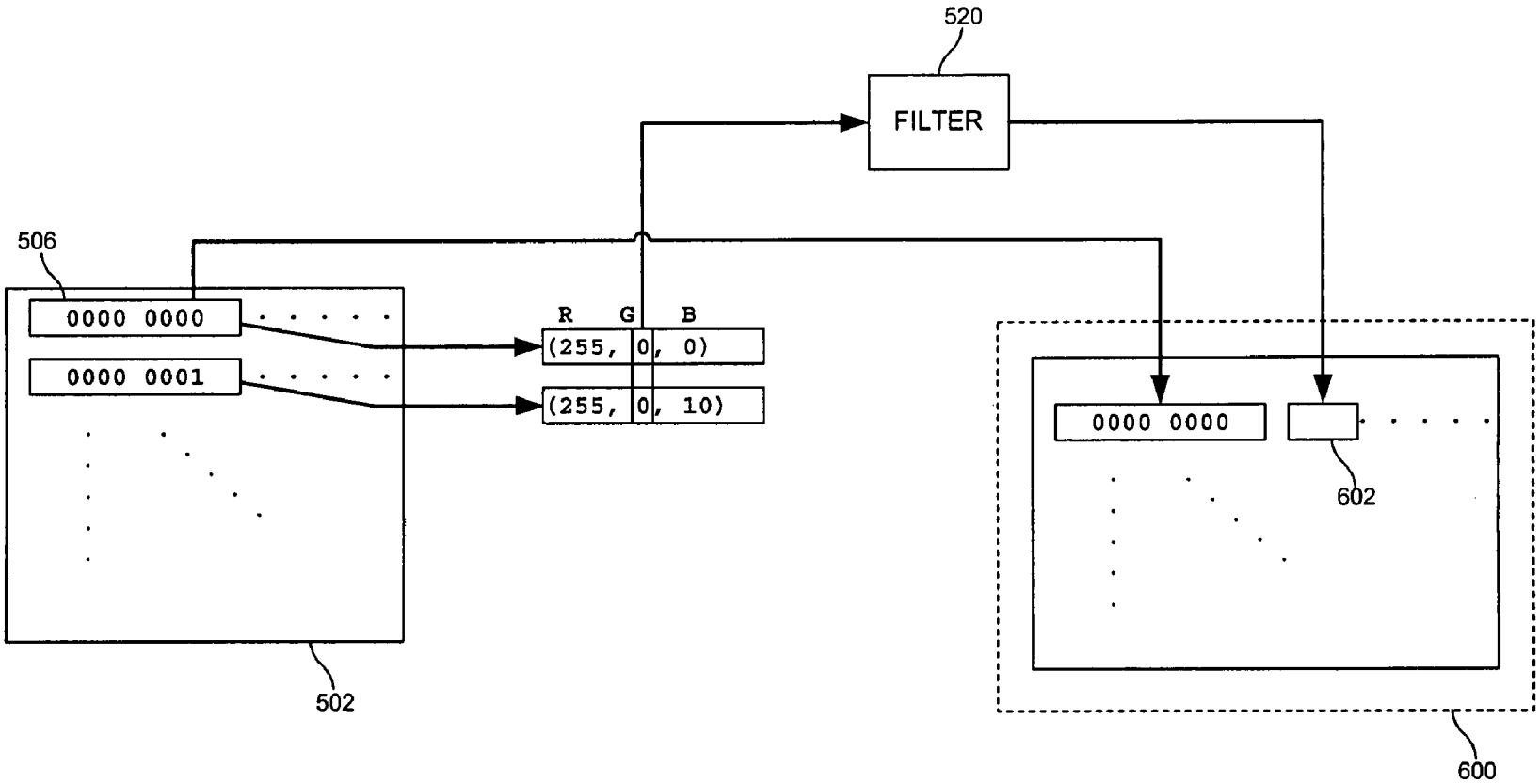
FIG. 6 is a schematic diagram illustrating the formation of a first example filtered image according to the method of FIG. 4.

FIG. 6 is a schematic diagram that illustrates the formation of an example filtered image file 600. As shown in FIG. 6, filtered image file 600 is formed by storing each pixel (e.g., pixel 506) of pixel buffer 502 with filtered data such as, for example, a filtered green channel value 602.

Figure 7:
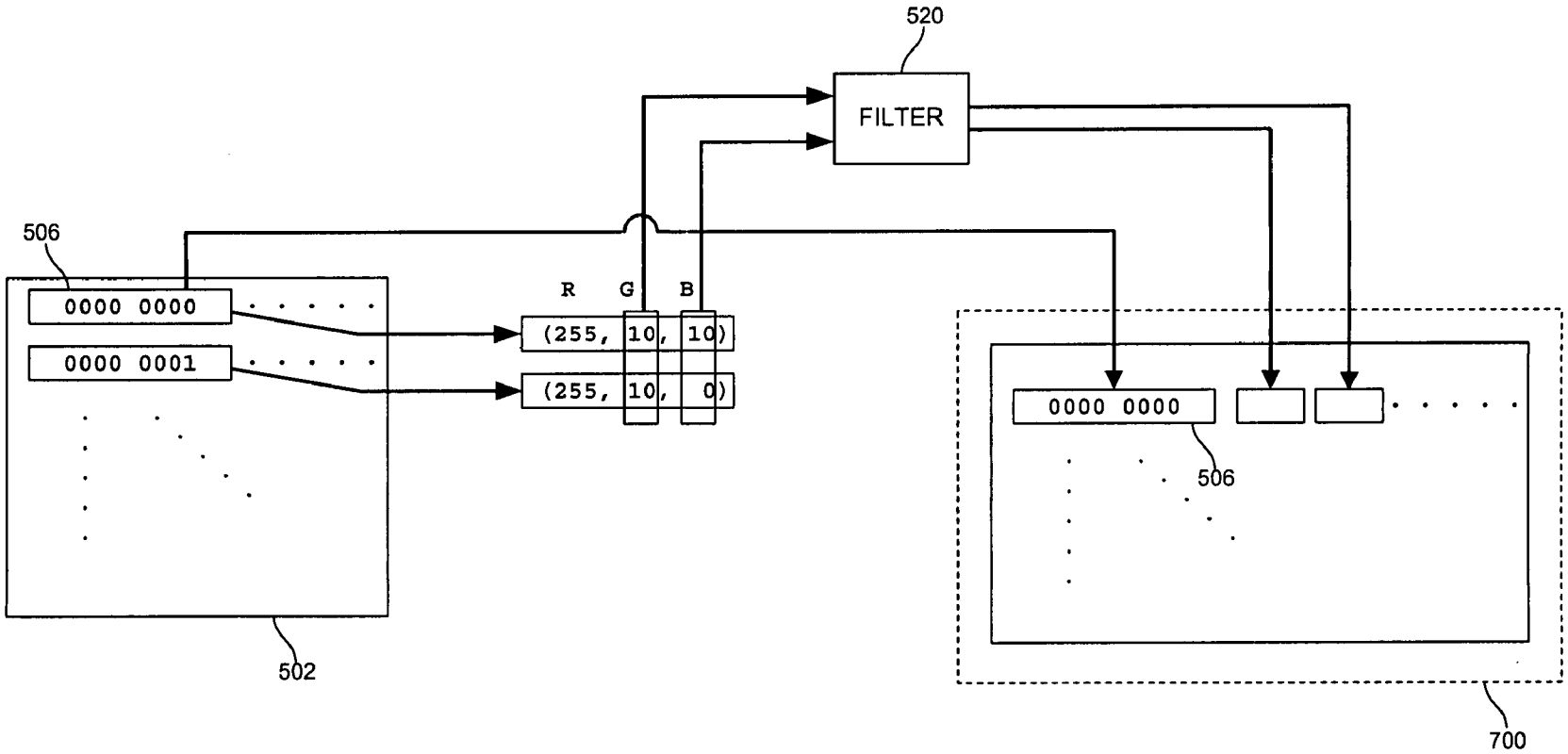
FIG. 7 is a schematic diagram illustrating the formation of a second example filtered image according to the method of FIG. 4.

FIG. 7 is a schematic diagram that illustrates the formation of an example filtered image file 700. As shown in FIG. 7, filtered image file 700 is formed by storing each pixel of pixel buffer 502 with filtered data such as, for example, a filtered green channel value and a filtered blue channel value. As with other filtered images files according to the present invention, filtered image file 700 need not exist as a separate data structure from pixel buffer 502 to implement the present invention.

Figure 8:
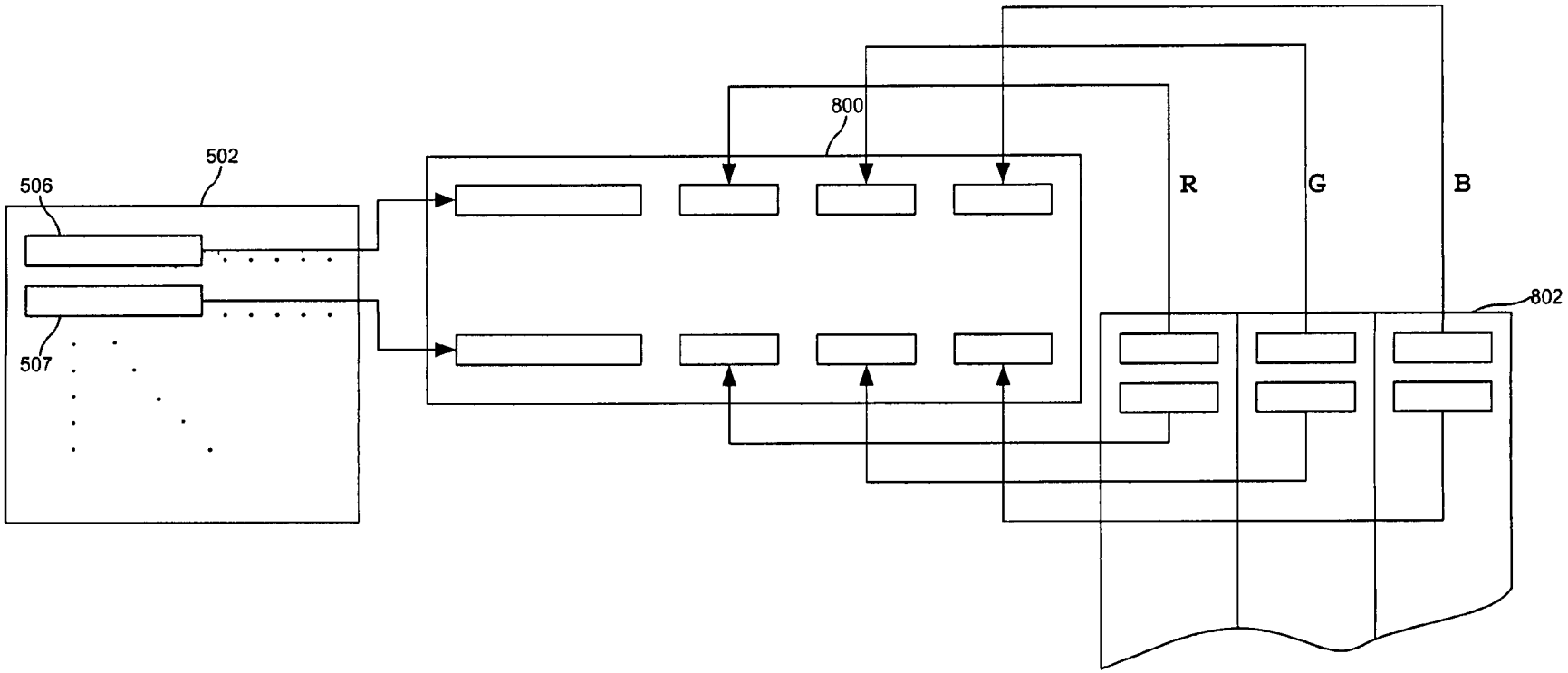
FIG. 8 is a schematic diagram illustrating the formation of a third example filtered image according to the method of FIG. 4.

FIG. 8 is a schematic diagram that illustrates the formation of an example filtered image file 800. As shown in FIG. 8, filtered image file 800 is formed by storing each pixel (e.g., pixels 506 and 507) of pixel buffer 502 with filtered data such as, for example, a filtered red channel value, a filtered green channel value, and a filtered blue channel value (e.g., from a filtered channel buffer 802).

Figure 9:
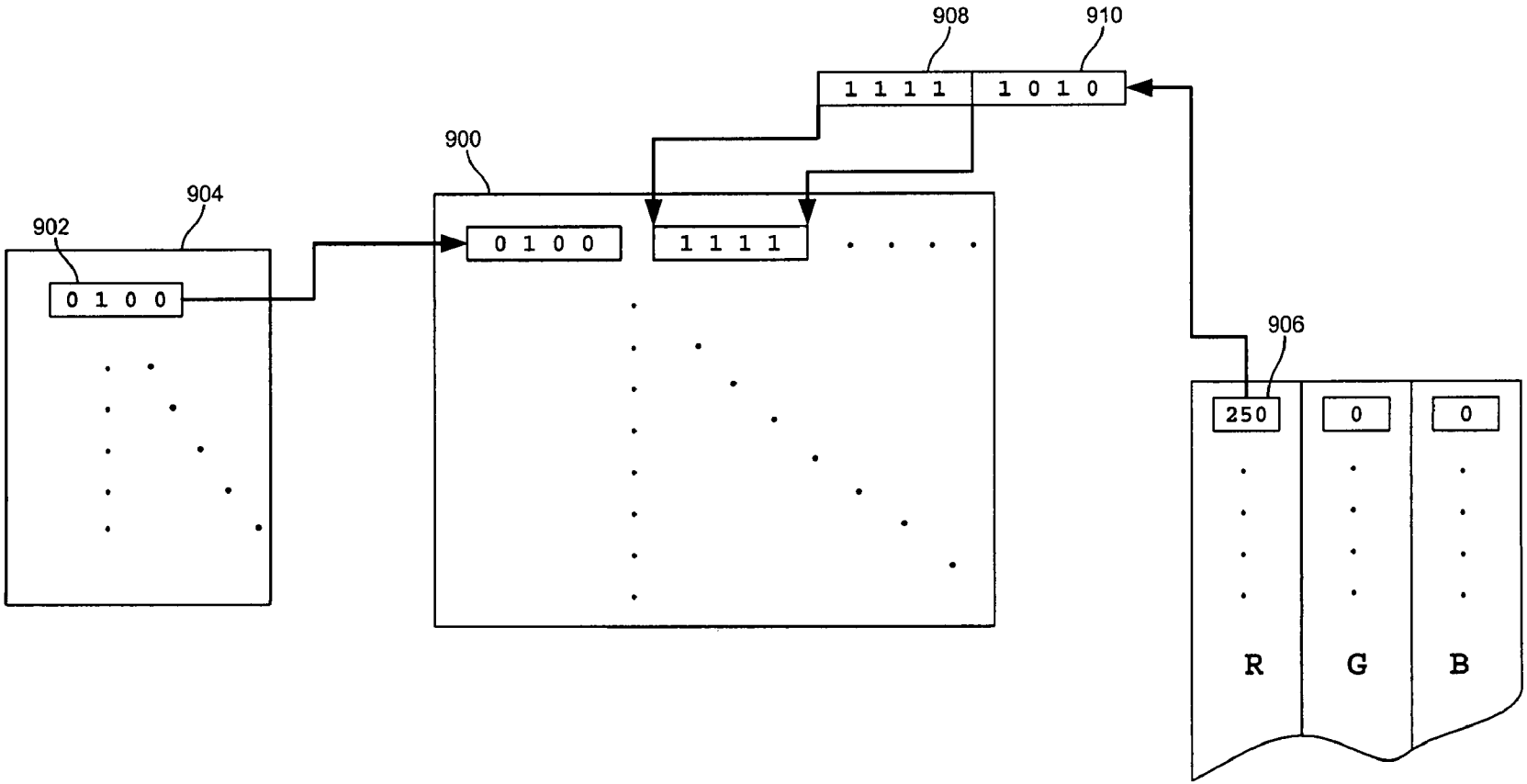
FIG. 9 is a schematic diagram illustrating the formation of a fourth example filtered image according to the method of FIG. 4.

FIG. 9 is a schematic diagram that illustrates the formation of an example filtered image file 900. As shown in FIG. 9, filtered image file 900 is formed by storing each pixel 902 of a pixel buffer 904 with filtered data such as, for example, a filtered red channel value 906 having a most significant bit portion 908 and a least significant bit portion 910. As shown in FIG. 9, the red channel value, 250 (binary 11111010), has been truncated by disregarding its least significant portion 910 and stored with pixel 902 to form an entry in filtered image file 900.

The filtered images files described herein are exemplary. Persons skilled in the relevant art(s) will understand how to form other filtered image files according to the present invention given the description herein.

Figure 10:
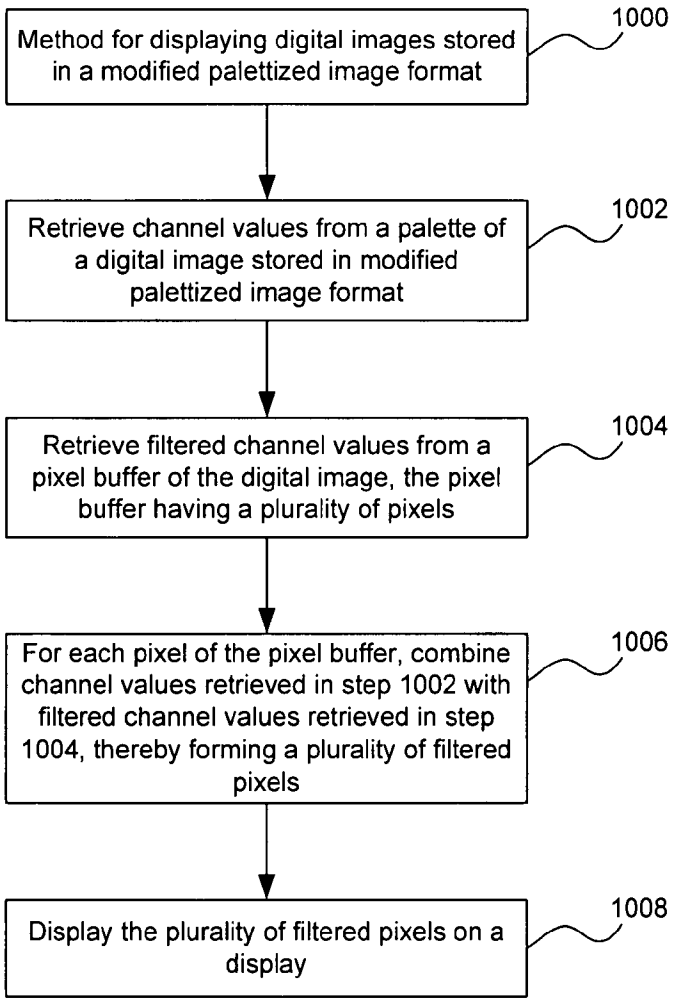
FIG. 10 is a flowchart illustrating a method for displaying an image stored in a modified palettized image format according to an embodiment of the present invention.

FIG. 10 is a flowchart of a method 1000 for displaying digital images stored in modified palettized image format. Method 1000 includes four steps 1002, 1004, 1006, and 1008.

In step 1002, channels values from a palette of a digital image stored in modified palettized image format are retrieved. Typically, this is done by de-referencing pixels in the pixel buffer using the palette.

In step 1004, filtered channel values are retrieved from a pixel buffer of the digital image. The pixel buffer includes a plurality of pixels.

In step 1006, for each pixel of the pixel buffer, channel values retrieved in step 1002 are combined with one or more filtered channel values retrieved in step 1004 to form filtered pixels. As used herein, filtered pixels are pixels that contain at least one filtered channel value. Channel values retrieved in step 1002 may also be used to render the digital image on a display without combining it with filtered channel values. Accordingly, the rendered image would not have any filtered channel data, representing the original unfiltered image.

In step 1008, the filtered pixels are displayed, for example on a display.

Figure 11:
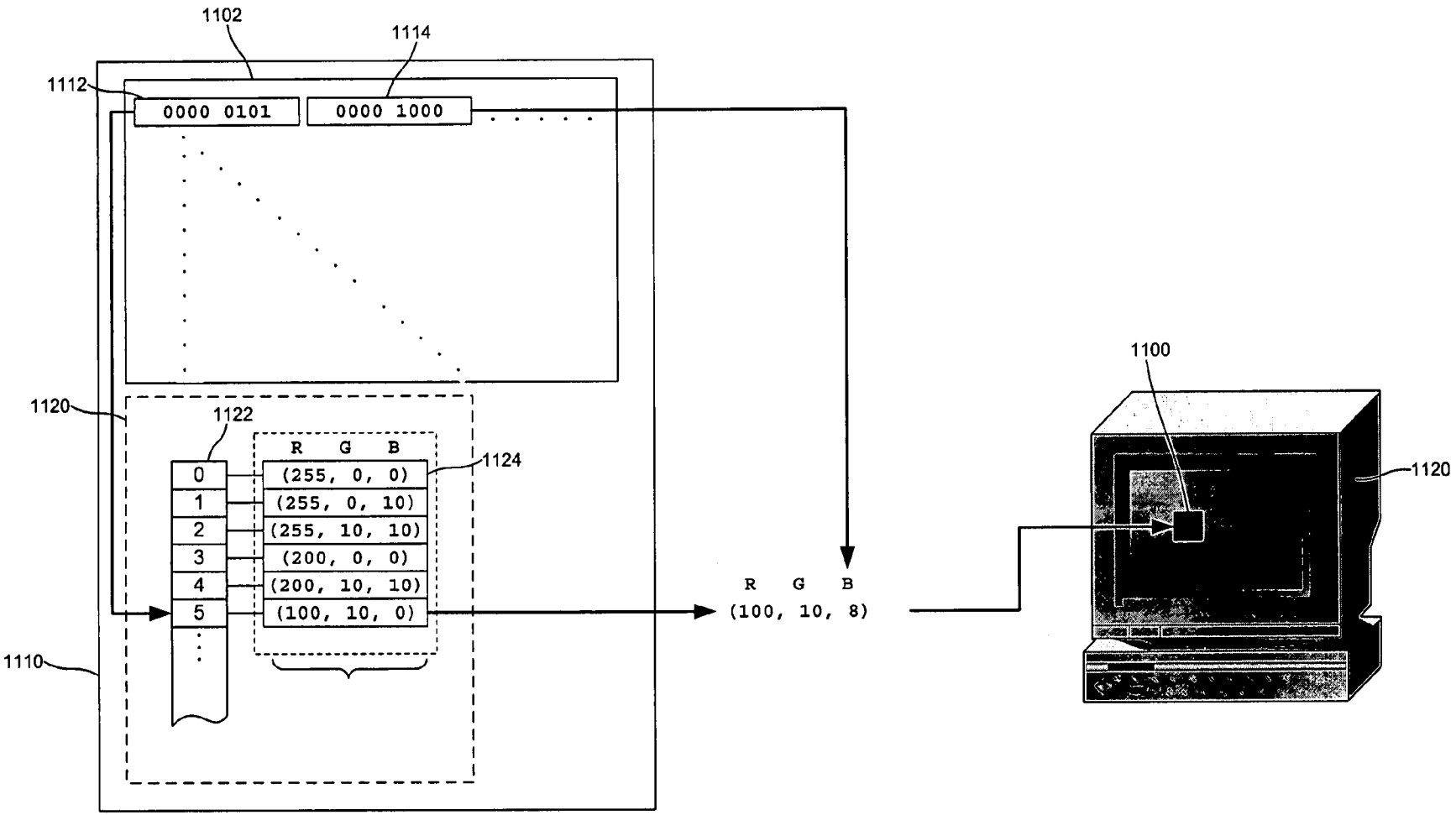
FIG. 11 is a schematic diagram illustrating the display of a filtered pixel on a display according to the method of FIG. 11.

FIG. 11 is a schematic diagram that further illustrates method 1000. As shown in FIG. 11, a filtered pixel 1100 can be displayed on a display 1120.

Filtered image file 1110 includes a pixel buffer 1102 and a palette 1120. Pixel buffer 1102 includes a plurality of pixels, wherein each pixel includes a pixel index 1112 and at least one filtered channel value, such as filtered channel value 1114. In the example of FIG. 11, filtered channel value 1114 represents a blue channel value.

Palette 1120 includes an index list 1122 and an array of channel values 1124. Each index in index list 1122 is associated with a vector of channel values in array 1124. The array of channel values 1124 includes red channel values, green channel values, and blue channel values. As already noted herein, other channel values can be used in accordance with the present invention.

As shown in FIG. 11, in step 1002 of method 1100, channel values are retrieved from palette 1120 of filtered image file 1110. In an embodiment, channel values are retrieved by de-referencing pixel indices (e.g., pixel index 1112) in the pixel buffer using the palette to obtain channel values.

In step 1004, filtered channel values (e.g, channel value 1114) are retrieved from pixel buffer 1102 of filtered image file 1110.

In step 1006, channel values retrieved in step 1002 are combined with filtered channel values retrieved in step 1004. In FIG. 11, note that filtered channel value 1114 replaces the actual blue channel value from the palette in the filtered pixel.

As will be understood by persons skilled in the relevant art(s), however, a filtered channel value may be numerically equivalent to its corresponding unfiltered value. This is because a filter may operate upon a channel value yet not change it. Thus, it is not necessary that each and every filtered channel value be numerically different from a corresponding unfiltered value. The value of each filtered channel value depends on the filter applied to it.

Figure 12:
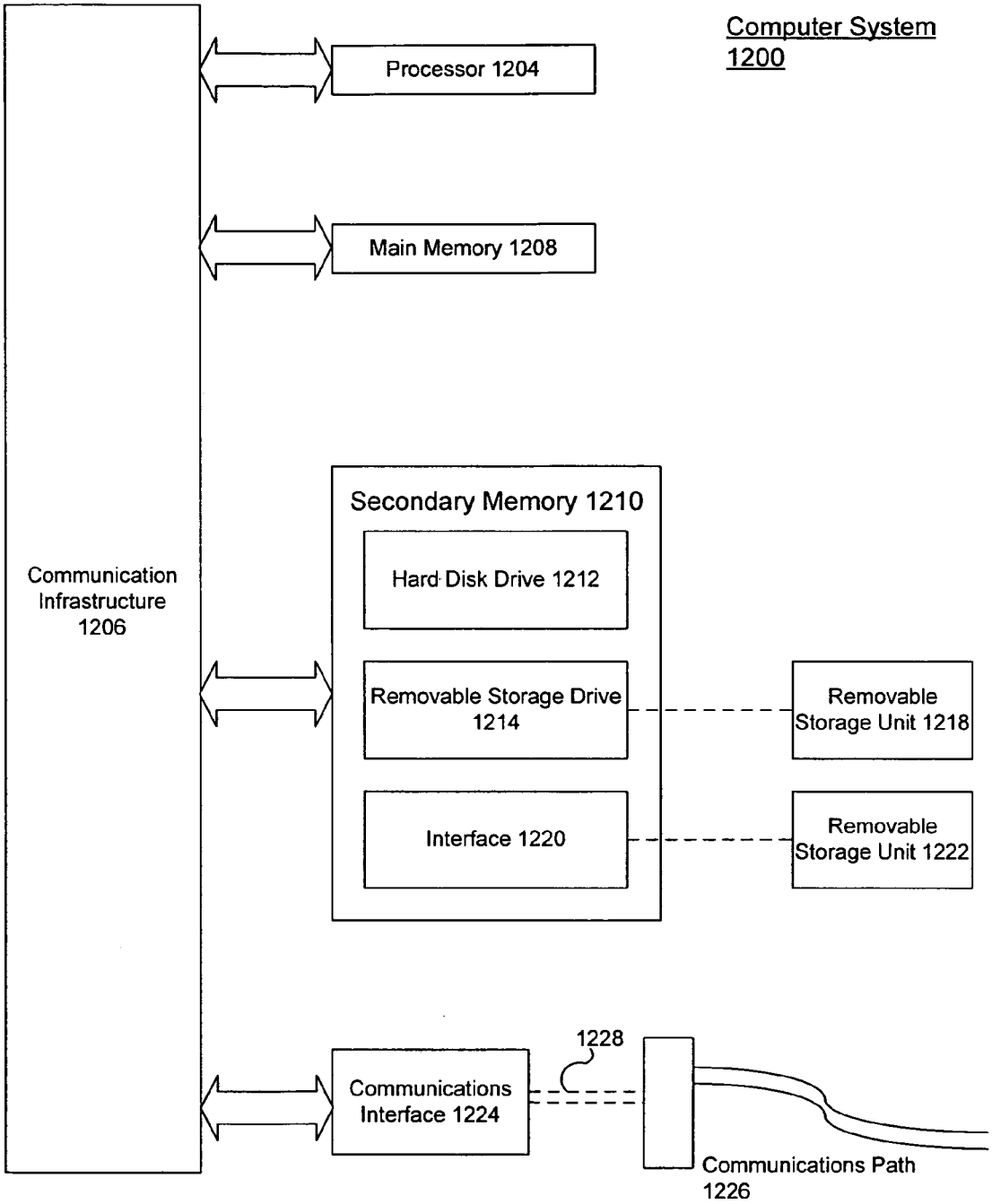
FIG. 12 is a schematic diagram of an example computer system capable of carrying out the functionality of the present invention.

The present invention may be implemented using hardware, software or a combination thereof and may be implemented in a computer system or other processing system. In an embodiment, the invention is directed toward a computer program product executing on a computer system capable of carrying out the functionality described herein. An example of computer system 1200 is shown in FIG. 12. Computer system 1200 includes one or more processors, such as processor 1204. Processor 1204 is connected to a communication bus 1206. Various software embodiments are described in terms of this example computer system. After reading this description, it will become apparent to a person skilled in the relevant art how to implement the invention using other computer systems and/or computer architectures.

Computer system 1200 also includes a main memory 1208, preferably random access memory (RAM), and may also include a secondary memory 1210. The secondary memory 1210 may include, for example, a hard disk drive 1212 and/or a removable storage drive 1214, representing a floppy disk drive, a magnetic tape drive, an optical disk drive, etc. The removable storage drive 1214 reads from and/or writes to a removable storage unit 1218 in a well-known manner. Removable storage unit 1218, represents a floppy disk, magnetic tape, optical disk, etc. which is read by and written to by removable storage drive 1214. As will be appreciated, the removable storage unit 1218 includes a computer usable storage medium having stored therein computer software and/or data.

In alternative embodiments, secondary memory 1210 may include other similar means for allowing computer programs or other instructions to be loaded into computer system 1200. Such means may include, for example, a removable storage unit 1222 and an interface 1220. Examples of such may include a program cartridge and cartridge interface (such as that found in video game devices), a removable memory chip (such as an EPROM, or PROM) and associated socket, and other removable storage units 1222 and interfaces 1220 which allow software and data to be transferred from the removable storage unit 1222 to computer system 1200.

Computer system 1200 may also include a communications interface 1224. Communications interface 1224 allows software and data to be transferred between computer system 1200 and external devices. Examples of communications interface 1224 may include a modem, a network interface (such as an Ethernet card), a communications port, a PCMCIA slot and card, etc. Software and data transferred via communications interface 1224 are in the form of signals 1228 which may be electronic, electromagnetic, optical or other signals capable of being received by communications interface 1224. These signals 1228 are provided to communications interface 1224 via a communications path (i.e., channel) 1226. This channel 1226 carries signals 1228 and may be implemented using wire or cable, fiber optics, a phone line, a cellular phone link, an RF link and other communications channels.

In this document, the terms "computer program medium" and "computer usable medium" are used to generally refer to media such as removable storage unit 1218 and a hard disk installed in hard disk drive 1212. These computer program products are means for providing software to computer system 1200.

Computer programs (also called computer program or control logic) are stored in main memory 1208 and/or secondary memory 1210. Computer programs may also be received via communications interface 1224. Such computer programs, when executed, enable the computer system 1200 to perform the features of the present invention as discussed herein. In particular, the computer programs, when executed, enable the processor 1204 to perform the features of the present invention. Accordingly, such computer programs represent controllers of the computer system 1200.

In an embodiment where the invention is implemented using software, the software may be stored in a computer program product and loaded into computer system 1200 using removable storage drive 1214, hard drive 1212 or communications interface 1224. The control logic (software), when executed by the processor 1204, causes the processor 1204 to perform the functions of the invention as described herein.

In another embodiment, the invention is implemented primarily in hardware using, for example, hardware components such as application specific integrated circuits (ASICs). Implementation of the hardware state machine so as to perform the functions described herein will be apparent to persons skilled in the relevant art(s).

CONCLUSION

The present invention puts forward a novel solution for filtering palettized image formats. While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A method for filtering digital images stored in palettized image format, comprising:

(1) retrieving data from a digital image stored in palettized image format, wherein the digital image is represented by a pixel buffer having a plurality of pixels, each pixel having a value that references an index in a palette, the palette including a plurality of channel values, each channel value associated with one of a plurality of channels of the palette;

(2) filtering data associated with a first channel of the palette to generate filtered data associated with said first channel of the palette; and (3) storing the filtered data and the plurality of pixels in a linked manner together with the palette, thereby forming a filtered image.

2. The method of claim 1, wherein step (1) comprises retrieving Red, Green, and Blue channel values.

3. The method of claim 1, wherein step (1) comprises retrieving Luminance, Red Chrominance, and Blue Chrominance channel values.

4. The method of claim 3, wherein step (2) comprises filtering the Luminance channel values.

5. The method of claim 1, wherein step (2) further comprises:

filtering data associated with a second channel of the palette.

6. The method of claim 5, wherein step (3) comprises:

for each pixel in the pixel buffer, storing the pixel with a first filtered value associated with the first channel and a second filtered value associated with the second channel.

7. The method of claim 1, wherein step (3) comprises storing the filtered data together with the plurality of pixels in the pixel buffer.

8. A method for displaying digital images stored in a modified palettized image format, comprising:

(1) retrieving channel values from a palette of a digital image stored in modified palettized image format, wherein the digital image stored in modified palettized image format is represented by the palette and a pixel buffer having a plurality of pixels, wherein each pixel in the pixel buffer includes a pixel index and an associated at least one filtered channel value;

(2) retrieving filtered channel values from the pixel buffer of the digital image;

(3) for each pixel of the pixel buffer, combining channel values retrieved in step (1) with filtered channel values retrieved in step (2), thereby forming a plurality of filtered pixels; and (4) displaying the plurality of filtered pixels on a display.

9. The method of claim 8, wherein the palette includes a plurality of channel values, each channel value associated with one of a plurality of channels of the palette, and step (3) comprises:

for each pixel of the pixel buffer, combining a first channel value retrieved in step (1) with a first filtered channel value retrieved in step (2).

10. The method of claim 8, wherein the palette includes a plurality of channel values, each associated with one of a plurality of channels of the palette, and step (3) comprises: for each pixel of the pixel buffer, combining a first channel value retrieved in step (1) with a first filtered channel value and a second filtered channel value retrieved in step (2).

11. A system for displaying digital images stored in a modified palettized image format, comprising:

first means for retrieving channel values from a palette of a digital image stored in modified palettized image format, wherein the digital image stored in modified palettized image format is represented by the palette and a pixel buffer having a plurality of pixels, wherein each pixel in the pixel buffer includes a pixel index and an associated at least one filtered channel value;

second means for retrieving filtered channel values from a pixel buffer of the digital image;

means for combining, for each pixel value of the pixel buffer, channel values retrieved in step (1) with filtered channel values retrieved in step (2), thereby forming a plurality of filtered pixels; and means for displaying the plurality of filtered pixels on a display.

12. The system of claim 11, wherein the palette includes a plurality of channel values, each associated with one of a plurality of channels of the palette, and wherein the means for combining combines a first channel value retrieved using the first means with a first filtered channel value retrieved using the second means.

13. The system of claim 11, wherein the palette includes a plurality of channel values, each associated with one of a plurality of channels of the palette, and the means for combining combines a first channel value retrieved using the first means with a first filtered channel value and a second filtered channel value retrieved using the second means.

14. A computer program product comprising a computer useable hardware medium for storing computer program logic that enables a processor-based system to filter digital images stored in palettized image format, the computer program comprising:

computer program logic that enables the processor-based system to retrieve data from a digital image stored in palettized image format, wherein the digital image is represented by a pixel buffer having a plurality of pixels, each pixel having a value that references an index in a palette, the palette including a plurality of channel values, each channel value associated with one of a plurality of channels of the palette;

computer program logic that enables the processor-based system to filter data associated with a first channel of the palette to generate filtered data associated with said first channel of the palette; and computer program logic that enables the processor-based system to store the filtered data and the plurality of pixels in a linked manner together with the palette, thereby foaming a filtered image.

15. The computer program product of claim 14, wherein the palette comprises Red, Green, and Blue channels.

16. The computer program product of claim 14, wherein the palette comprises Luminance, Red Chrominance, and Blue Chrominance channels.

17. The computer program product of claim 16, wherein the first channel is the Luminance channel.

18. The computer program product of claim 14, wherein the computer program logic that enables the processor-based system to filter data associated with a first channel of the palette further enables the processor-based system to filter data associated with a second channel of the palette.

19. A computer program product comprising a computer useable hardware medium for storing computer program logic that enable a processor-based system to display digital images stored in a modified palettized image format, the computer program comprising:

first computer program logic that enables the processor-based system to retrieve channel values from a palette of a digital image stored in modified palettized image format, wherein the digital image stored in modified palettized image format is represented by the palette and a pixel buffer having a plurality of pixels, wherein each pixel in the pixel buffer includes a pixel index and an associated at least one filtered channel value;

second computer program logic that enables the processor-based system to retrieve filtered channel values from a pixel buffer of the digital image;

third computer program logic that enables the processor-based system to combine, for each pixel value of the pixel buffer, channel values retrieved using the first computer program logic with filtered channel values retrieved using the second computer program logic, thereby forming a plurality of filtered pixels; and fourth computer program logic that enables the processor-based system to display the plurality of filtered pixels on a display.

20. The computer program product of claim 19, wherein the palette includes a plurality of channel values, each associated with one of a plurality of channels of the palette, and the third computer program logic enables the processor-based system to combine, for each pixel of the pixel buffer, a first channel value retrieved using the first computer program logic with a first filtered channel value retrieved using the second computer program logic.

21. The computer program product of claim 19, wherein the palette includes a plurality of channel values, each associated with one of a plurality of channels of the palette, and the third computer program logic enables the processor-based system to combine, for each pixel of the pixel buffer, a first channel value retrieved using the first computer program logic with a first filtered channel value and a second filtered channel value retrieved using the second computer program logic.

* * * * *